United States Patent [19]

Minalga

[11] 4,433,817

[45] Feb. 28, 1984

[54] SPOOL PIN HOLDER FOR A SEWING MACHINE

[75] Inventor: Philip F. Minalga, Piscataway, N.J.

[73] Assignee: The Singer Company, Stamford, Conn.

[21] Appl. No.: 426,354

[22] Filed: Sep. 29, 1982

[51] Int. Cl.[3] ..... B65H 49/18

[52] U.S. Cl. ..... 242/134; 242/130.4

[58] Field of Search ..... 242/129.5, 129.7, 129.8, 242/130.3, 130.4, 134, 139; 223/106; 112/270

[56] References Cited

U.S. PATENT DOCUMENTS

| | | | |
|---|---|---|---|
| 2,527,192 | 10/1950 | Mangiaracina | 242/139 X |
| 2,858,089 | 10/1958 | Yasui | 242/134 |
| 3,224,708 | 12/1965 | Laidig | 242/129.8 |
| 3,444,833 | 5/1969 | Blackwood et al. | 112/270 |

FOREIGN PATENT DOCUMENTS

| | | |
|---|---|---|
| 1043774 | 4/1954 | Fed. Rep. of Germany . |
| 30-17468 | 11/1955 | Japan . |
| 33-482494 | 10/1958 | Japan . |
| 43-774 | 4/1968 | Japan . |
| 49-16158 | 2/1974 | Japan . |

*Primary Examiner*—Leonard D. Christian

*Attorney, Agent, or Firm*—Edward P. Schmidt; Robert E. Smith; Edward L. Bell

[57] ABSTRACT

A spool pin holder for accommodating deflection of a spool pin wherein a spherical segment adjacent the ends of the spool pin is seated in a socket in a spool pin post adjacent a socket of square profile having grooves extending along the diagonals of the square beyond the square so as to accommodate therein a first pair of leaf springs in a first diagonal on either side of a spool pin end and a second pair of leaf springs in the second diagonal about the spool pin end adjacent the first pair so as to provide a restoring force to the spool pin in response to any disturbing force displacing the same.

4 Claims, 4 Drawing Figures

SPOOL PIN HOLDER FOR A SEWING MACHINE

DESCRIPTION

Background of the Invention

This invention relates to sewing machines; more particularly, to a means for supporting a spool of thread on a sewing machine.

In particular, the invention is concerned with a mounting for a sewing machine spool pin which has a good degree of resiliency to prevent damage from the inadvertent application of excessive force which might cause breakage thereof. Some examples are shown in the prior art of spool pins and mountings therefor which have some degree of resilience. Such a spool pin mounting is shown in the U.S. Pat. No. 3,224,708, issued on Dec. 21, 1965 to Laidig. In this U.S. patent, the spool pin is retained to a sewing machine cover through a pair of resilient dampers supported on the spool pin one on each side of the cover. In the German Pat. No. 1,043,774, filed on Apr. 8, 1954, the use of a coil spring is disclosed having a turned over end to provide an interference fit to the internal diameter of a cop or spool pin. The Japanese UM Publications NOS. 7774/68 and 17468/55 disclose, respectively, spool pins retained in a grommet captured in a hole in a top cover and a spool pin having a ball and socket arrangement which is attached to a top cover.

These prior art spool pin devices are, for the most part, entirely adequate to perform their function but might be characterized as being unattractive, expensive or subject to material change from hardening which will effect their performance. What is required is a mounting arrangement for a spool pin which is attractive, compact, inexpensive and capable of long term stability to insure its continued functioning in the manner intended.

SUMMARY OF THE INVENTION

The above ends are attained in a spool pin holder extending centrally of an integral spherical segment adjacent one end thereof, which segment is seated in a socket cavity. The end of the spool pin beyond the spherical segment extends between a first pair of leaf springs whose ends are trapped in a groove and between a second pair of leaf springs situated substantially transversely to the first and also having its ends captured in grooves. Force supplied to the spool pin will cause pivoting of the spherical segment in the socket and the end of the spool pin will engage a leaf spring of the first pair of leaf springs, or a leaf spring of the second pair, of leaf springs, or a leaf spring from each pair, to apply a restoring force. The grooves may be of a width somewhat less than the combined thickness of the spool pin and the pair of leaf springs so as to maintain the leaf springs under tension at all times to obviate the effects of wear.

DESCRIPTION OF THE DRAWINGS

The invention is illustrated in the accompanying drawings in which:

Referring to FIG. 1, there is shown a portion of a sewing machine 10 including a top cover 12 and a handwheel 14. Shown in the top cover 12, is a recess 16 for accommodating a thread spool supported on spool pin 20. Adjacent the recess 16, is a cavity 22 specifically shaped to accommodate the extremity 24 of a spool pin post 26. A screw 25 extends through the top cover 12 into the extremity 24 of spool pin post 26 to retain the same attached thereto. The post 26 is fashioned with a socket 28 at the base of a cavity 30 having a square profile. An aperture 29 extends from the center of the socket through the post 26. The corners of the square cavity 30 are fashioned with grooves 32 extending the depth of the cavity and some distance beyond the cavity towards the periphery of the post 26, but leaving sufficient material to insure integrity thereof. A first pair of leaf springs 34 are accommodated in diagonally opposite grooves 32 at the base of the cavity 30, and a second pair of leaf springs 36 are accommodated in the remaining grooves so that the pairs of leaf springs are orthogonal to each other.

Figure 1:
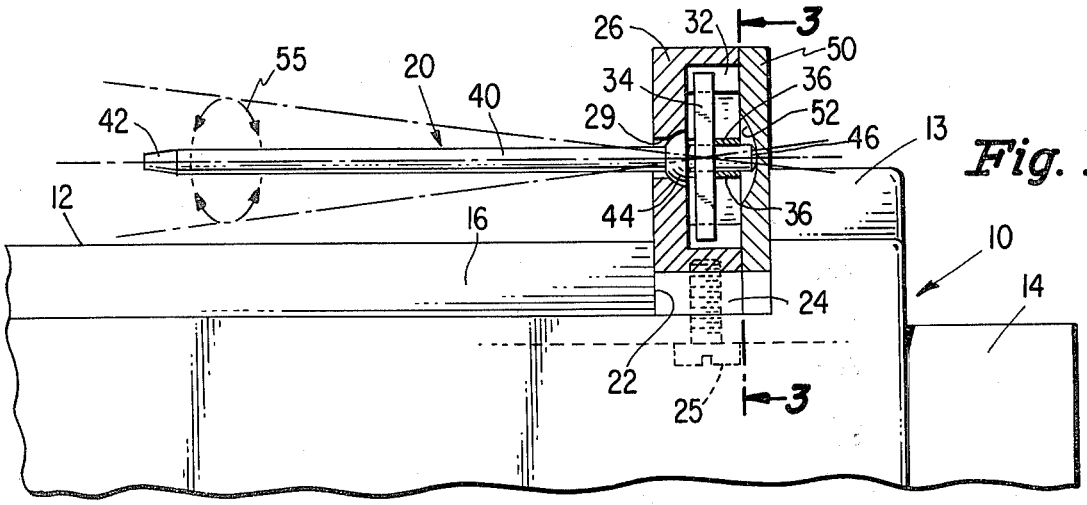
FIG. 1 is an elevation of a portion of a sewing machine cover and horizontally extending spool pin, partly in section.

A spool pin 40 is provided having a tapered end 42 providing a lead in for a thread spool. The spool pin 40 is sufficiently smaller than the aperture 29 to permit angular extension therethrough as indicated in phantom in FIG. 1. The other end of the spool pin 40 is fashioned with a spherical segment 44 spaced from the end thereof, which segment is designated for complemental engagement with the socket 28 in the post 26. The end 46 of the spool pin 40 adjacent the spherical segment 44, may be suitably curved to match with spherical cavity 52 in a cover plate 50 which may be attached to the post 26 as shown in FIG. 1, by any suitable means such as an adhesive. In order to provide additional support for the cover plate 50, against thrust of the spool pin 40, the top cover 12 may be fashioned with a built-up section 13 behind the cover plate.

In assembly, the spool pin 40 is inserted through the aperture 29 in post 26 so that the spherical segment 44 seats in the socket 28, and the leaf springs 34 and 36 may be assembled about the end 46 of the spool pin in the grooves 32, in orthogonal relationship. The grooves 32 in the post 26 may be fashioned slightly smaller than the combined thickness of a pair of leaf springs and the end 46 of the spool pin 40. Initial tension thus provided to the leaf springs 34, 36 will assist in maintaining a tight assembly over the life of the machine to which it is attached.

Figure 3:
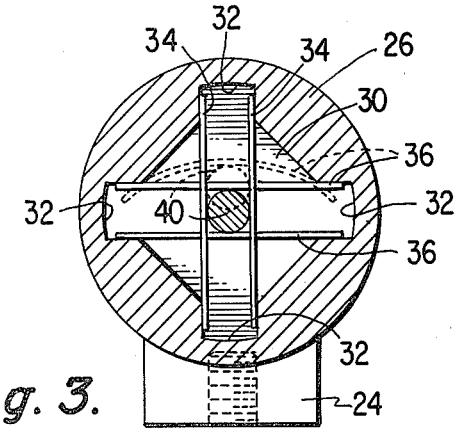
FIG. 3 is a view taken substantially along the lines 3—3 of FIG. 1 and showing in phantom, the spool pin deflected to distort one leaf spring; and, FIG. 4 is a view similar to that shown in FIG. 3, however with the spool pin shown in phantom as deflecting a leaf spring from separate pairs of leaf springs.
Figure 4:
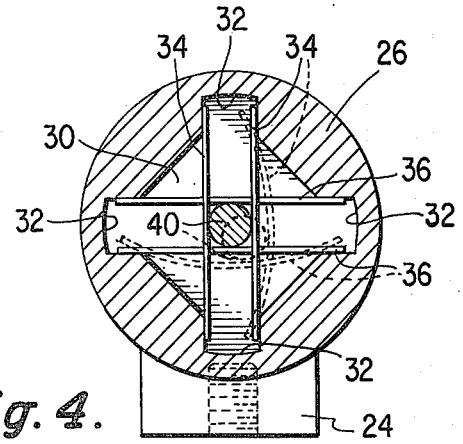
Figure 2:
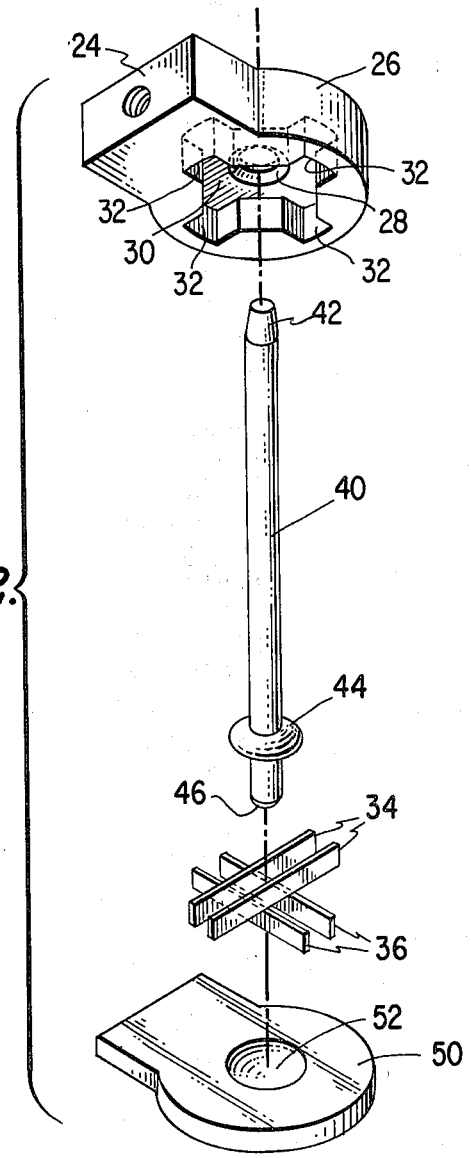
FIG. 2 is an exploded perspective of the spool pin arrangement shown in FIG. 1.

In FIG. 1 the phantom circle 55 indicates the extent of motion possible for the spool pin 40 as a result of this invention. In FIG. 3, is shown in phantom the position of one of the leaf springs 34 as a result of deflection of the spool pin 40 within the leaf springs 16 without deflection of the same. It is apparent that the deflected leaf spring 34 has permitted a limited motion of the spool pin 40 and is supplying a restoring force thereto to restore the position of the spool pin when the disturbing force is removed therefrom. In FIG. 4, there is shown in phantom, the action of the end 46 of the spool pin 40 on a leaf spring from each of the pair of leaf springs 34, 36. Under this circumstance, both of the leaf springs are exerting a restoring force on the end 46 of the spool pin 40 so as to return the spool pin to a central position once the disturbing force is removed.

The construction herein disclosed permits the spool pin 40 to be fashioned selectively from a synthetic resin material or from metal for increased rigidity and strength. The arrangement disclosed allows the use of a rigid spool pin which is not subject to destruction upon inadvertent deflection thereof. It will be apparent to those skilled in the art that this arrangement, although disclosed with a horizontal spool pin, may also be readily implemented with a vertical spoon pin and be equally efficacious. Such other constructions embodying the principles herein disclosed are deemed to be within the scope and spirit of this disclosure. It is to be understood that the preferred embodiment described herein is for the purposes of illustration only, and not to be construed as a limitation of the invention.

I claim:

1. A spool pin mounting arrangement for a thread spool comprising a spool pin extending along a first length at least a sufficient distance to accommodate said thread spool, said spool pin including a spherical segment having said first length adjacent one side thereof and a second length to an end thereof adjacent the other side of said segment; a spool pin post having a socket complemental to and accommodating said spherical segment of said spool pin and an aperture extending from the center of said socket to the outside of said spool pin post capable of accommodating said spool pin up to a selected angular orientation therein, means operating on said second length of said spool pin for resiliently allowing said spool pin to displace to said selected angular orientation in said aperture in response to a disturbing force and for applying a restoring force thereto in opposition to said disturbing force for returning said spool pin to a central position upon removal of said disturbing force.

2. A spool pin mounting arrangement as claimed in claim 1 said operating means further comprising a square cavity in said spool pin post into which said socket opens, said square cavity being grooved with parallel sided grooves along diagonals beyond the corners thereof; a first pair of leaf springs carried in said grooves along one diagonal of said square cavity adjacent said socket, one on each side of said second length of said spool pin; and a second pair of leaf springs carried in said grooves along the other diagonal of said square cavity adjacent said first pair of leaf springs, one on each side of said second length of said spool pin.

3. A spool pin mounting arrangement as claimed in claim 2 wherein said parallel sided grooves along the diagonal of said square cavity are separated by a distance less than the sum of the thickness of a pair of leaf springs and said spool pin.

4. A spool pin mounting arrangement as claimed in claim 3 further comprising means for closing off said square cavity opposite said socket so as to retain the spool pin beyond said spherical segment and said first and second pair of leaf springs in said square cavity.

* * * * *